US005202302A

United States Patent [19]

De La Pena et al.

[11] Patent Number: 5,202,302

[45] Date of Patent: Apr. 13, 1993

[54] PREPARATION OF ACTIVATED CARBONS BY IMPREGNATION WITH A BORON COMPOUND AND A PHOSPHORUS COMPOUND

[76] Inventors: John M. D. De La Pena, Old Farm House, Hanwell, Nr. Banbury, Oxon OX17 1HN; Richard A. Roberts, 5 York Close, Towcester, Northants NN12 7JE, both of Great Britain

[21] Appl. No.: 476,362

[22] PCT Filed: Sep. 26, 1989

[86] PCT No.: PCT/GB89/01135

§ 371 Date: Jul. 19, 1990

§ 102(e) Date: Jul. 19, 1990

[87] PCT Pub. No.: WO90/03458

PCT Pub. Date: Apr. 5, 1990

[30] Foreign Application Priority Data

Sep. 26, 1988 [GB] United Kingdom ..... 8822518

[51] Int. Cl.[5] ..... C01B 31/12; D01F 9/12

[52] U.S. Cl. ..... 502/425; 264/29.2; 423/447.5; 502/180; 502/423; 502/426; 502/427

[58] Field of Search ..... 502/425, 426, 423, 416; 423/447.5, 447.2; 264/29.2

[56] References Cited

U.S. PATENT DOCUMENTS

| | | | |
|---|---|---|---|
| 3,969,268 | 7/1976 | Fukuda et al. | 502/425 |
| 4,197,279 | 4/1980 | Saito et al. | 423/447.5 |
| 4,412,937 | 11/1983 | Ikegami et al. | 502/425 |
| 4,699,896 | 10/1987 | Sing et al. | 502/423 |

FOREIGN PATENT DOCUMENTS

| | | |
|---|---|---|
| 62-15645 | 4/1987 | Japan . |
| 1267201 | 3/1972 | United Kingdom . |
| 1455531 | 11/1976 | United Kingdom . |
| 2003843 | 3/1979 | United Kingdom . |
| 2099409 | 12/1982 | United Kingdom . |
| 2164327 | 3/1986 | United Kingdom . |

*Primary Examiner*—Paul E. Konopka
*Attorney, Agent, or Firm*—Young & Thompson

[57] ABSTRACT

A process is provided for preparing fibrous or film type activated carbon including the steps of carbonizing a cellulosic material and activating the resulting carbon, each stop occurring at a temperature between 200° C. and 1100° C. in an oxidation-suppressing atmosphere, in which, prior to activation, the cellulosic material or carbon is impregnated with at least one boron-containing compound and at least one phosphorus-containing compound. This impregnation treatment greatly increases the activation rate, so reducing the activation time and therefore energy costs. Higher levels of production of fibrous activated carbons can thus be achieved.

13 Claims, 1 Drawing Sheet

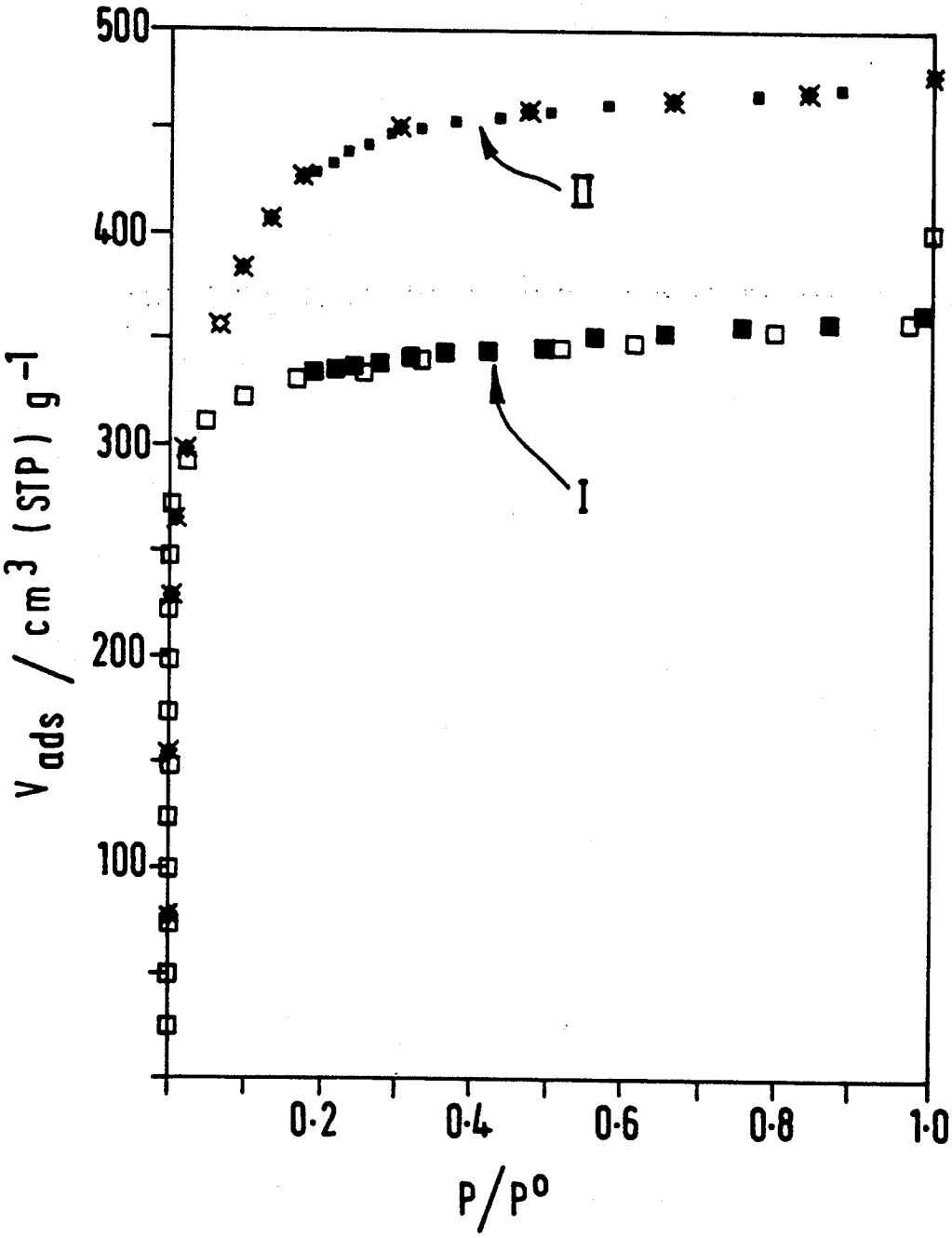
500
400
300
200
100
$V_{ads}$ / $cm^3$ (STP) $g^{-1}$
II
I
0·2
0·4
0·6
0·8
1·0
P/P°

PREPARATION OF ACTIVATED CARBONS BY IMPREGNATION WITH A BORON COMPOUND AND A PHOSPHORUS COMPOUND

TECHNICAL FIELD

The invention relates to the manufacture of fibrous or film-type activated carbons which can be used as supports for catalysts or for the adsorption of materials from a gaseous and/or liquid phase in applications such as, for example, industrial filtration, decolouration of solutions, air filtration, respirators, air-conditioning, filter hoods, adsorption from solution, medical, bacterial or viral adsorption or filtration and microtoxin adsorption.

Processes for producing fibrous or film-type activated carbons have been known for some years. Such processes chiefly comprise carbonising fibrous organic starting materials by heating in an inert atmosphere to drive off volatile matter and then 'activating' the material to form the desired porous active surface in the carbonised fibrous material (char) by further heating to a temperature higher than the carbonising temperature.

It has been found in such processes that pre-treatment with various chemicals prior to the carbonisation step greatly enhances the quality of the activated carbon product. For example in GB Patent No. 1301101 a method of making activated fibrous carbon is disclosed in which the fibrous starting material is treated with one or more alkali metal halides, collectively known as 'Lewis acids'. A disadvantage of this pre-treatment is that it is only capable of generating a microporous (pore diameter 2 nm) material and for some applications, in particular when the activated fibrous carbon is used as a catalyst support, a mesoporous (pore diameter 2 to 50 nm) material is preferred.

An improved activated carbon fibre material having high adsorbancy and superior physical strength is also disclosed in GB Patent No. 1455531 in which during manufacture a cellulose fibre is impregnated with a phosphorus compound prior to carbonisation. More recently, in GB-A-2164327, a process has been described for making an activated carbon fibrous material having a substantial percentage of mesopores in which pretreatment comprises impregnation with one or more compounds of boron and at least one alkali metal.

DISCLOSURE OF THE INVENTION

An impregnation treatment has now been found which, depending on the activation conditions, can result in a microporous or mesoporous carbon, without the incorporation of Lewis acids, and which allows pore size distribution to be controlled.

In accordance with the invention a process for preparing fibrous or film type activated carbon comprises the steps of carbonising a celluloses material and activating the resulting carbon between 200° C. and 1100° C. in an inert atmosphere wherein prior to activation the celluloric material or carbon is impregnated with at least one boron-containing compound and at least one phosphorus-containing compound.

Preferably at least one boron-containing compound and at least one phosphorus-containing compound are combined in an impregnation preparation. The boron-containing compound may be an acid or a salt. Particularly suitable boron-containing compounds are boric acid, boric oxide, borax, sodium metaborate, sodium tetraborate, lithium metaborate, lithium pentaborate, lithium tetraborate, potassium tetraborate or potassium metaborate. Particularly suitable phosphorus containing compounds are acids such as phosphoric acid, metaphosphoric acid, pyrophosphoric acid, phosphorus acid, phosphonic acid, phosphonous acid, phosphinic acid and phosphinous acid, or their salts, or phosphonium salts, phosphines and phosphine oxides. The impregnation preparation may contain a mixture of several of the aforementioned boron compounds combined with a mixture of several of the aforementioned phosphorus compounds.

The boron and phosphorus compounds which form the impregnating preparation may be impregnated onto or into the carbon by contacting the carbon with the impregnating preparation when the preparation is dissolved in a solvent and then drying the carbon leaving the boron and phosphorus compounds incorporated therein or as an external coating on the surface. The impregnation preparation should preferably be acidic in solution. Thus for acids of boron and phosphorus preferred solvents are water, ethanol, methanol, propanol, glycerol, acetate, isoamyl alcohol, ethylene glycol, and diethylether. For salts phosphorus or boron preferred solvents are mineral acids or formic acid.

The drying step may be effected at room temperature or more preferably the impregnated material is placed in a drying oven between the temperatures of 40° C. and 200° C. in either air or vacuum or an inert gas.

The total concentration of boron compounds dissolved or suspended in the solvent is preferably from 0.1% to 4.5% w/v (weight/volume) and particularly from 1 to 4%, while the total concentration of dissolved or suspended phosphorus compounds is preferably from 0.1% to 20% w/v.

It is generally preferable that the impregnation of the cellulosic material takes place prior to carbonisation although this is not essential. However where such is the case the amount of boron and phosphorus impregnated onto or into the cellulosic material may be from 0.01 to 20% and preferably from 0.1 to 10% by weight of cellulosic.

Following the impregnation treatment the cellulosic material can be carbonised and activated using well-known methods. The cellulosic material is first heated to temperatures between 200° C. and 850° C. to effect carbonisation and drive off volatile materials. It is then further heated to a temperature between 450° C. and 1000° C., preferably between 600° C. and 1000° C. to effect activation. Both the carbonisation and activation take place in an atmosphere that stops or suppresses oxidation and combustion. Typically, this comprises one of the following, nitrogen, noble gas, argon, helium, hydrogen, carbon monoxide, carbon dioxide, combustion gas from hydrocarbon fuels, steam, and hydrogen or any mixture thereof. During activation the oxidation suppressing atmosphere is usually carbon dioxide, steam, hydrogen or a mixture thereof.

Cellulosic materials receiving the impregnation treatment of the invention may equally well undergo carbonisation and activation in a batch furnace such as that described for example in GB Patent No. 1570677 or in a furnace adapted for continuous feed such as that described in GB Patent No. 1310011.

The fibrous or film-type carbon product may be in the form of filament, yarn, thread or tow, or knitted or woven or non-woven cloth, film, felt or sheets. Suitable starting materials for the process of the invention include cellulosic material such as rayon, wool, lignin, viscose, wood pulp, cotton, paper, or coal base, nut shell or nut kernel, or seed pips and also man-made organic polymers or any composite of any of the above. Some of these fibrous materials may be rendered stiff and inflexible by the impregnation treatment and a softening step will be required. However it has been found that by careful selection of suitable grades of material this softening step can be avoided.

Impregnation of the cellulosis starting materials with compounds of phosphorus and boron in accordance with the invention produce carbonisation yields between 20% and 40% when the impregnation solution is acid. Activation times are generally between 1 and 240 minutes but activation is preferably continued until the resulting carbon has an apparent surface area in excess of 700 $m^2g^{-1}$. The activation yield is preferably between 25% and 95% with the percentage 'burn-off' during activation being between 5% and 75%.

At low 'burn-off' levels the process of the invention produces a product which is highly microporous and as the percentage burn-off increases so an increase in micropore size distribution is achieved. At high percentage 'burn-off' some mesopores are produced, the process of the invention being capable of producing an activated carbon having a non-microporous area between 20–70 $m^2g^{-1}$. As previously mentioned, mesoporous material is particularly useful as a catalyst support. On the other hand highly microporous material is preferred for adsorption and filtration applications.

A further advantage of the impregnation process of the invention is that activation rates are considerably increased compared with impregnation treatments hitherto known. Thus the activation time is reduced, so increasing production rates of the activated carbon while reducing the energy costs.

DESCRIPTION OF THE DRAWING

The accompanying drawing shows the adsorption/-desorption hysteresis isotherms for similar samples of activated carbon cloth according to the invention but manufactured with different percentage burn-offs.

BEST MODE OF CARRYING OUT THE INVENTION

The invention will now be described with reference to the following five examples, in each of which a sample of viscous rayon cloth 21 centimeters by 30 centimeters was impregnated with a solution, dried, carbonised and then activated, the final sample of activated carbon cloth being tested so as to allow a comparison of the effects of different impregnation solutions and activation processes.

Each sample was immersed in the impregnation solution for 30 seconds, dried on blotting paper to remove excess solution, and then dried in an oven at 55° C. The dried sample was suspended in a vertical tube furnace and pyrolysed in a stream of inert gas. The weight loss of the sample during pyrolysis can be continuously measured by a calibrated electronic balance mounted on a frame above the furnace.

Pyrolysis involved a carbonisation stage during which the sample was heated from ambient temperature at a rate of 10° C. per minute to 850° C. in a flow of nitrogen gas. This was followed by an activation stage during which the inert gas was changed to carbon dioxide and the furnace temperature maintained at 850° C. for a sufficient length of time to achieve a desired percentage 'burn-off' of the carbonised cloth. This is assessed using the balance to measure the weight of the sample at the end of the carbonisation stage and thereafter monitoring the weight of the sample during the activation stage until the loss of weight as a percentage of the weight after carbonisation reaches the desired percentage burn-off. The percentage burn-off for the first four examples 1 to 4 quoted below was 25%, and the percentage burn-off for the fifth example 5 quoted below was 62%.

The impregnation solution used in each example was an aqueous solution of phosphoric acid and boric acid in the particular amounts quoted by percentage weight per volume (w/v) in the Table below.

The characteristics of the pore structure of the final samples of activated carbon cloth are determined from adsorption/desorption hysteresis isotherms at 77° K. obtained by subjecting the cloth to an increasing pressure of nitrogen gas so as to cause increasing amounts of nitrogen to adsorb onto the carbon, and then decreasing the pressure of nitrogen to cause the nitrogen to desorb from the carbon. The nitrogen pressure p is measured as a fraction ($p/p_o$) of the saturated vapour pressure $p^o$ of nitrogen at the isotherm temperature of 77° K., and the amount of nitrogen adsorbed Vads is measured as centimeters cubed at standard temperature and pressure of adsorbed nitrogen per gram of carbon ($cm^3/gm$). Two such isotherms for example 4 (Curve I) and example 5 (Curve II) from the Table are illustrated in the accompanying drawing.

From the isotherms produced for each of the samples of carbon cloth, the apparent surface area A was determined by the method of Brunnauer, Emmett and Teller (known as the BET area) described in "Pure and Applied Chemistry, Volume 57, No. 4, pages 603–619; 1985. These surface areas A are quoted in the Table.

Also the total pore volume $V_T$ ($cm^3$/gram) was calculated from the isotherms using the equation:

$$V_T = V_{0.95} 0.00156 \text{ cm}^3/\text{gram}$$

where $V_{0.95}$ is the value of the nitrogen amount read off the isotherm at the nitrogen pressure $p/p_o$ of 0.95. These volumes $V_T$ are quoted in the Table.

The carbonisation percentage yield was also measured based on the weight of the sample before and after carbonisation, and the result for each sample is quoted in the Table.

The physical properties of the final samples of activated carbon cloth were also measured in terms of tensile strength in Newtons/2.5 cm, and percentage elongation before breaking, and the results are quoted in the Table.

TABLE

| Eg. No. | Phosphoric Acid (W/V) | Boric Acid (W/V) | Burn Off (%) | Carbon Yield (%) | Tensile Strength (N/2.5 cm) | Elongation (%) | Pore Vol. (VT) | Apparent Surface Area(A) |
|---|---|---|---|---|---|---|---|---|
| 1 | 1 | 3 | 25 | 28.6 | 8.2 | 7.4 | 0.41 | 1006 |
| 2 | 3 | 4 | 25 | 34.2 | 18.2 | 8.5 | 0.40 | 885 |

TABLE-continued

| Eg. No. | Phosphoric Acid (W/V) | Boric Acid (W/V) | Burn Off (%) | Carbon Yield (%) | Tensile Strength (N/2.5 cm) | Elon-gation (%) | Pore Vol. (VT) | Apparent Surface Area(A) |
|---|---|---|---|---|---|---|---|---|
| 3 | 4 | 3 | 25 | 30.8 | 15.8 | 8.1 | 0.43 | 1026 |
| 4 | 5 | 3 | 25 | 33.2 | 10.0 | 6.9 | 0.56 | 1276 |
| 5 | 5 | 3 | 62 | 33.8 | 6.1 | 6.7 | 0.73 | 1629 |

The test results obtained from these samples demonstrate that carbon cloth can be manufactured with a wide range of pore volumes and apparent surface areas and with a variation in pore size distribution. In particular, the shape of the isotherms in the drawing show the effect of varying percentage burn-off, example 4 (Curve I) with 25% burn-off being typical of a carbon with a more limited range of pore sizes suitable for adsorption of specific molecules, whilst example 5 (Curve II) with 62% burn-off is typical of a carbon with a wider range of sizes of micropores and mesopores suitable for adsorption of larger molecules. The tensile strength and elongation of the carbon of example 5 is lower as a result of the higher burn-off, but these are still at acceptable values.

We claim:

1. A process for manufacturing activated carbon from cellulose fibre or film including the steps of carbonising the cellulose and activating the resulting carbon, each step occurring at a temperature between 200° C. and 1100° C. in an oxidation suppressing atmosphere, said activation being continued for a sufficient time to produce activated carbon having an apparent surface area in excess of 700 $m^2g^{-1}$, wherein prior to the activation step, the cellulose or carbon is impregnated with at least one boron-containing acidic compound and at least one phosphorous-containing acidic compound.

2. A process as claimed in claim 1, wherein said boron-containing acidic compound and said phosphorous-containing acidic compound are combined in an impregnating preparation.

3. A process as claimed in claim 2, wherein impregnation is effected by contacting the cellulose or carbon with the impregnation preparation when said impregnation preparation is dissolved or suspended in a solvent and thereafter drying the cellulose or carbon to leave the preparation impregnated thereon or therein.

4. A process as claimed in claim 3, wherein the impregnation preparation is acidic in solution.

5. A process as claimed in claim 3, wherein the solvent is selected from the group consisting of methanol, ethanol, propanol, glycerol, acetone, isoamylalcohol, ethylene glycol and diethylether.

6. A process as claimed in claim 3, wherein the total concentration of boron-containing acidic compounds dissolved or suspended in the solvent is between 0.1% and 4.5% w/v.

7. A process as claimed in claim 6, wherein the total concentration of boron-containing acidic compounds dissolved or suspended in the solvent is between 1% and 4% w/v.

8. A process as claimed in claim 3, wherein the total concentration of phosphorous-containing acidic compounds dissolved or suspended in the solvent is between 0.1% and 20% w/v.

9. A process as claimed in claim 1, wherein the boron-containing acidic compound is boric acid.

10. A process as claimed in claim 1, wherein the phosphorous-containing acidic compound is selected from the group consisting of phosphoric acid, metaphosphoric acid, pyrophosphoric acid, phosphorus acid, phosphonic acid, phosphonous acid, phosphinic acid and phosphinous acid.

11. A process as claimed in claim 1, wherein the cellulose is impregnated prior to carbonization.

12. A process as claimed in claim 11, wherein the amount of boron and phosphorous impregnated onto or into the cellulose is from 0.01 to 20% by weight of the cellulose.

13. A process as claimed in claim 12, wherein the amount of boron and phosphorous impregnated onto or into the cellulose is from 0.1 to 10% by weight of the cellulose.

* * * * *